US005812401A

United States Patent [19]

Moore

[11] Patent Number: 5,812,401

[45] Date of Patent: Sep. 22, 1998

[54] ADDRESS VERIFICATION ON A POSTAGE METER VAULT

[75] Inventor: Wayne D. Moore, Shelton, Conn.

[73] Assignee: Pitney Bowes Inc., Stamford, Conn.

[21] Appl. No.: 724,941

[22] Filed: Oct. 2, 1996

[51] Int. Cl.[6] ..... G07B 17/04

[52] U.S. Cl. ..... 705/410; 235/382

[58] Field of Search ..... 235/375, 382, 235/382.5; 340/825.3, 825.31, 825.34, 825.35; 364/464.2

[56] References Cited

U.S. PATENT DOCUMENTS

| | | | |
|---|---|---|---|
| 3,692,988 | 9/1972 | Dlugos et al. | 235/151.33 |
| 4,097,923 | 6/1978 | Eckert, Jr. et al. | 364/464.13 |
| 4,285,050 | 8/1981 | Muller | 364/464.15 |
| 4,743,747 | 5/1988 | Fougere et al. | 235/494 |
| 4,812,994 | 3/1989 | Taylor et al. | 364/464.2 |
| 4,868,757 | 9/1989 | Gil | 364/464.03 |
| 4,908,770 | 3/1990 | Breault et al. | 364/464.14 |
| 5,065,000 | 11/1991 | Pusic | 235/381 |
| 5,159,667 | 10/1992 | Borrey et al. | 395/148 |
| 5,239,168 | 8/1993 | Durst, Jr. et al. | 235/432 |
| 5,319,562 | 6/1994 | Whitehouse | 364/464.03 |
| 5,337,246 | 8/1994 | Carroll et al. | 364/464.02 |
| 5,509,109 | 4/1996 | Kim et al. | 395/114 |

*Primary Examiner*—Edward R. Cosimano
*Attorney, Agent, or Firm*—Robert H. Whisker; Melvin J. Scolnink; Robert E. Meyer

[57] ABSTRACT

A portion of an address, such as a delivery point bar code (DPBC), a zip code, or similar postal code definition is stored in a postage meter. The stored address information is compared with an intended recipient's address inputted to the postage meter, and is used to stop users from illicitly using a postage meter to perform personal mailings, or otherwise to use the postage meter contrary to authorization given by a funding customer. The invention may also be used for allocation and tracking of payments for various mail charges in accordance with inputted address information.

16 Claims, 3 Drawing Sheets

START REQUEST FUNDS
70

72
CHECK FLAG ON?
NO
YES
OPERATOR PROMPTED TO "ENTER DPBC"
74
DPBC ENTERED ON KEYBOARD OR SCANNED FROM MAILPIECE
76
78
MATCH MADE AGAINST LIST OF SUPERVISOR'S DPBC?
NO
YES
82
PROMPT OPERATOR FOR SUPERVISOR PASSWORD
80
RELEASE FUNDS FOR POSTAGE FROM METER VAULT
YES
84
CORRECT PASSWORD ENTERED?
NO
YES
VAULT POWER ON?
NO
86
END REQUEST FOR METER FUNDS
88

ADDRESS VERIFICATION ON A POSTAGE METER VAULT

FIELD OF THE INVENTION

This invention relates generally to postage meters operating in combination with postal coding and bar code addressing printers, and more specifically to securing usage of a meter system and to providing accurate accounting of such usage.

BACKGROUND OF THE INVENTION

Postage meters are mass produced devices for printing value units for governmental or private carrier delivery of parcels and envelopes. Such postage meters typically print a postage indicia in the upper right hand corner of one surface of an envelope or package. This indicia has come to take a specific form, in which a postage amount is contained in a rectangular border and the date of the postage impression appears in a circular border. Also included in this indicia is the postage meter number and the city and state from which the envelope was mailed.

Because the indicia printed by a postage meter represents value and the meter is a value printing device, security factors have been of paramount significance in the design and construction of postage metering systems. Indeed, postal authorities have required adequate security devices to insure that the postage printed by such meters is accounted for.

Postage meters thus typically include an internal accounting device which accounts for the postage value available to, and dispensed (printed) by, the postage meter. The accounting device accounts for recharging of the meter with additional postage value, as well as for use of the postage value units, such as by a printing mechanism of the postage meter. Inasmuch as an external independent accounting system is typically unavailable for accounting for the postage printed by the meter, postage meters must possess high reliability and absolute security, with respect both to the printing portion of the meter and to the accounting portion thereof, in order to avoid the loss of governmental funds. That is, a postage meter is printing value and, unless appropriate security measures are taken, one would be able to print unauthorized postage, and thus to defraud the U.S. Postal Service.

Various prior art approaches have been taken to ensure reliability and security of the value, or funds, represented by information stored in a postage meter. Such security measures include both physical measures, to prevent access to and modification of the value stored in the meter, and the use of encryption, to ensure that a printed postage indicia is valid, such as by including various information therein. Thus, these approaches ensure against tampering with the stored information, to prevent unauthorized increases in (or recharging of) postage value available in the postage meter. Known security measures also prevent printing of value units without properly reducing the available charge to provide an accounting therefor. Prior systems have also relied upon the post office to account for postage by monitoring the number and value of mail pieces sent by a particular meter user.

Although postage meters have performed satisfactorily in the past, and continue to perform satisfactorily in the present, it will be appreciated that the above described approaches relate to prevention of unauthorized modification of information internally stored within the meter, as well as to prevention of printing of indicia which are not properly supported (or accounted for) by the accounting device of the postage meter. Thus, the prior art has functioned well to prevent defrauding of the Postal Service.

However, similar steps have not been equally implemented to assure that use of a properly funded and accounted postage meter is in accordance with authorization of the funding customer, to assure that an appropriate accounting is made of meter use, and to prevent the printing of indicia which, though properly supported and accounted for by the accounting device, are not carried out for an authorized purpose of the customer, thus defrauding the funding customer of funds paid to the Postal Service.

That is, in a customer facility having a properly operating and accounting postage meter, it is possible for an individual to use the meter for printing value units on mail pieces, which have not been authorized by the customer. For example, an employee having authorized access to a postage meter may use the meter to print indicia on personal mail pieces. As such an operation does not tamper with the meter, does not attempt to recharge the meter improperly, and does not attempt to print indicia without properly charging or accounting therefor, the above described security measures can neither detect nor prevent such unauthorized use.

Postage systems are thus needed that are capable of accounting for proper use of a postage meter. Still more particularly, postage systems are needed which are capable of restricting use of a postage meter. Additionally, postage systems are needed which are capable of detecting and preventing unauthorized use.

SUMMARY OF THE INVENTION

In accordance with the invention, address information is used to prevent unauthorized postage taking. By categorizing use of a postage meter in accordance with recipient address information, there is provided a straightforward approach to accounting for use of postage value. Moreover, such information is used to restrict use of the postage meter to addresses meeting certain predetermined criteria. The recipient address information is used to detect and prevent unauthorized use of a postage meter. In one approach, the zip code entered into the postage meter for an addressee of a particular mail piece is matched against a list of zip codes to which the funding customer ordinarily sends mail pieces. When the entered zip code is not in the list, a postage indicia will not be printed. In another approach, an accounting of the number of mail pieces sent to various zip codes, and the value units assigned thereto, is maintained to enable the funding customer to allocate postage costs to different categories.

From the foregoing, it will be appreciated that it is an object of the present invention to provide a postage system having a capability of properly allocating postage expenses to a number of categories in accordance with addressee information.

It is a further object of the invention to provide a system for securing a postage meter from unauthorized use thereof by persons having authorized access thereto.

Another object of the invention is to provide a system for accounting for different categories of authorized use, and for preventing unauthorized use, of a postage meter in accordance with address information.

It is still another object of the invention to use a zip code to account for different categories of authorized use of a postage meter and to prevent unauthorized use thereof.

These and other objects, features and advantages of the present invention will become readily apparent to those skilled in the art from the following description and drawings, wherein there is shown and described a preferred embodiment of the invention, simply by way of illustration and not of limitation of one of the best modes (and alternative embodiments) suited to carry out the invention. The invention itself is set forth in the claims appended hereto. As will be realized upon examination of the specification and drawings and from practice of the same, the present invention is capable of still other, different, embodiments and its several details are capable of modifications in various obvious aspects, all without departing from the scope of the invention as recited in the claims. Accordingly, the drawings and the descriptions provided herein are to be regarded as illustrative in nature and not as restrictive of the invention.

BRIEF DESCRIPTION OF THE DRAWINGS

The accompanying drawings, incorporated into and forming a part of the specification, illustrate several aspects of a preferred embodiment of the present invention and, together with the description, serve to explain the principles of the invention. In the drawings.

is

DETAILED DESCRIPTION OF THE PREFERRED EMBODIMENTS

It should be appreciated that, although the background and disclosure provided herein refers to postage meters, the term postage meter also includes other meters which print value units. For example, the invention is applicable to parcel service meters, tax stamp meters, check writing meters, ticket imprinters, and other similar devices.

Figure 1:
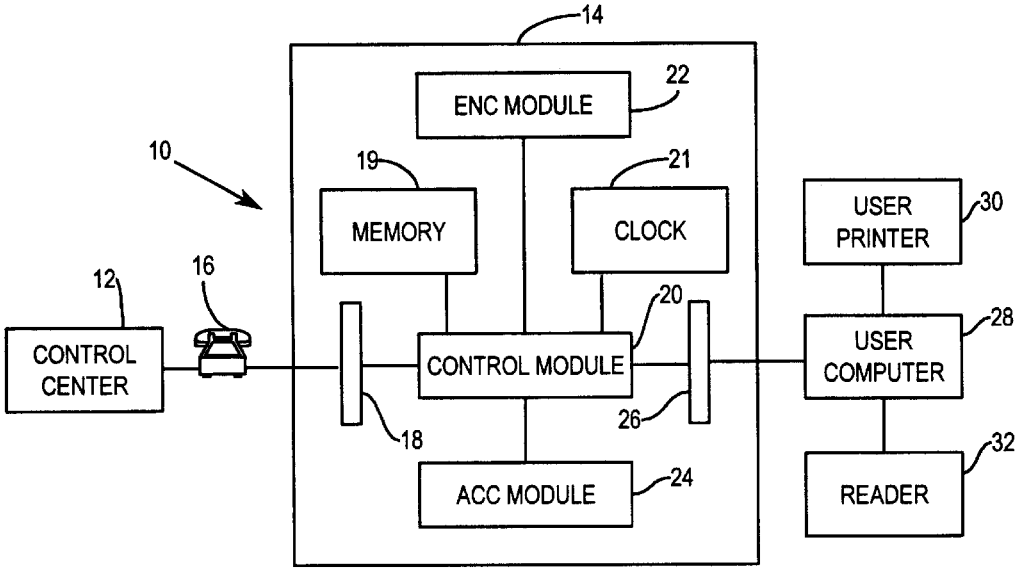
FIG. 1 shows a block diagram of a system that utilizes the instant invention.

Referring now to FIG. 1, a postage and mailing information applying system which can utilize the present invention is shown generally at 10. Such a system is more fully set forth in U.S. Pat. No. 4,743,747 to Guy L. Fougere, et al., and is assigned to the assignee hereof. The disclosure of U.S. Pat. No. 4,743,747 is hereby incorporated by reference.

As seen in FIG. 1, a postage and address applying system generally includes a control center 12 and an accounting unit 14 that are in communication with one another through a communicating device such as a telephone 16, a facsimile machine, a telex machine, and the like.

Located within the accounting unit 14 is a modem or converter 18 which provides communication between the telephone 16 and a control module 20 of the accounting unit. The control module may be a CPU, such as an Intel Pentium microprocessor available from Intel Corporation, Santa Clara, Calif., or any other suitable microprocessor. The control module 20 has a memory 19 and a clock 21. The memory and clock may either be integral with the control module or may be configured in connection therewith. As disclosed in the above noted '747 patent, memory 19 may store a transaction number, a customer number and the like. For a system utilizing encryption, an encryption module 22 is provided in communication with the control module 20, as is an accounting module 24. However, it should be appreciated that the encryption module 22 and the accounting module 24, in and of themselves, are known and are not parts of the present invention although they may be used in implementing the invention.

The encryption module may be any of a number of readily available encryption devices which may, for example, encrypt in accordance with the NBS Data Encryption Standard (DES) pursuant to a preset secure key. An example of a suitable encryption module 22 is identified in the '747 patent. The accounting module 24 may be a battery augmented RAM that incorporates ascending and descending registers. As is known from previous postage metering devices, the ascending register is the register that records the amount of postage that is dispensed or printed on each transaction and the descending register is the register that records the value, or amount, of postage that may be dispensed, and decreases from an original or charged amount as postage is printed.

Another modem 26 within the accounting unit 14, provides communication between the control module 20 and a user computer 28. The user computer may be any typical computer that has input, logic and output for example, such as is commonly available in commerce. Connected to the user computer 28 is a user printer 30. Preferably, printer 30 is of a type which is capable of printing any configuration, including bar codes and alpha numerics. The user printer may thus be a laser printer, an inkjet printer, a dot matrix printer, or any other suitable printing device. Accounting unit 14 may thus be thought of as a vault storing the value to be printed (and dispensed by) printer 30, for example.

User computer 28 may also have a reader 32 connected thereto, to permit data entry by reading mail pieces, envelopes, or the like. Reader 32 may optically scan written data, or may otherwise detect the presence of data on an envelope, such as by reading bar codes, magnetic patterns (such as magnetic ink in MICR codes) or other well known forms of data presentations.

In the block diagram shown in FIG. 1, the control center 12 may be a Post Office which serves as a source of postage value. Systems are known whereby a postage meter may be charged remotely upon provision of an assigned customer number by a user to the Post Office. See for example U.S. Pat. No. 4,097,923. In turn, the Post Office provides a postage value that is automatically added to the customer's postage meter, in this case by the accounting unit 14. The postage value is added to the amount in the descending register portion of the accounting module 24 to increase that amount to a value that is the sum of the added postage value being charged and the unused amount remaining from previous charging, In the system of FIG. 1, the postage meter may include the accounting unit 14 as a secure portion thereof. Accounting unit 14 is thus preferably configured so that tampering by physical, electronic or magnetic means is inhibited. Security features such as shields, break away bolts and the like are well known and the means for securing the accounting unit 14 will not be further described. In one embodiment, the accounting unit 14 has no display and may only be accessible by the user computer 28 upon receipt by control module 20 thereof of an assigned code word from the user computer 28. It will be understood that the user printer 30 is not necessarily a secure printer, and neither are the links between the user computer 28 and the accounting unit 14 and the user computer and the user printer.

Where encryption is utilized to enhance security, the postage information to be printed by the user printer 30 may include an encryption number that is generated by the encryption module 22. Encryption may be based upon any recognized code such as DES, supra, National Security Agency (NSA) cipher or Rivest, Shamir and Adleman (RSA) cipher, for example. Upon supplying the appropriate information to the accounting unit 14 from the user computer 28, the encryption module 22 of such a system generates an encryption number which is then communicated through the user computer 28 and printed by the user printer 30. This supplied information could include the customer number, the value of postage and the like.

In accordance with the preferred embodiment of the present invention, at least a delivery point bar code (DPBC), a zip code of the recipient, or the like, or other specified address information, is used by the invention to enhance security and accounting of the postage meter for the benefit of the funding customer. Postal codes in the form of computer readable representations on the exterior of mail pieces are being implemented by many postal services around the world to facilitate automated sortation and distribution processes. It is within the scope of the present invention to read such codes on preaddressed mail pieces, or to analyze codes inputted by a user for printing by user printer 30, to account for, and/or to prevent unauthorized use of, the postage meter.

By using the DPBC, zip code, or other such information of the addressee for security and accounting, the invention precludes a user from deliberately altering the information since such alteration will preclude the mail piece from being delivered to the user's intended addressee.

Figure 2:
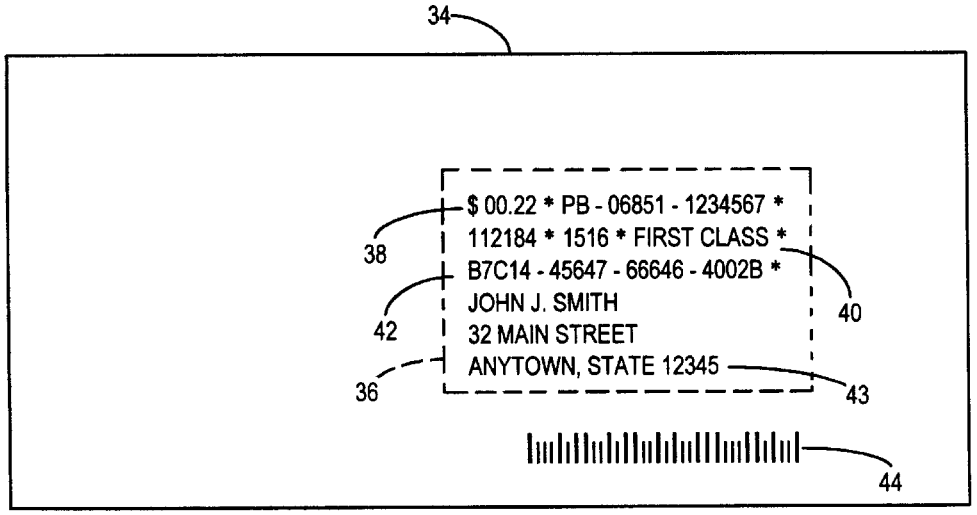
FIG. 2 is a plan view of an envelope having postage information printed thereon in the address field in accordance with the instant invention.

Referring now to FIG. 2, a format is shown therein for applying postage and mailing information to the address field of a mail piece such as an envelope 34. By postage information is meant postage amount, date of mailing, meter or customer number, transaction number, class of mail and the like. By address information is meant the house number, name, city, state, zip code, DPBC and the like of the mail recipient. In the configuration of FIG. 2, an envelope 34 is shown with a label 36 attached in the address field portion of the envelope. As used herein, the term address field has the meaning as defined in U.S. Postal Service regulations. Such definition may be found, for example, in the U.S. Postal Service pamphlet "Guide to Business Mail Properties," September, 1984, and in more recent editions as well. Although the format shown in FIG. 2 is described as a combination of a label 36 and envelope 34, it will be appreciated that the characters and codes may be printed directly upon the envelope or upon an insert placed within a window type envelope. It will be further understood that, where encryption of the type described in the aforementioned '747 patent is used, label 36 may be of the type described therein which is used instead of the normal indicia, without departing from the scope of the present invention.

In such an implementation, the first line 38 of the label may include information relative to the amount of postage and the customer number. The second line 40 may contain the date of the mailing, the time the postage is imprinted and the class of mail. The third line 42 may contain an encryption message in the form of numbers and letters that may be derived by the encrypting module 22 from the information on the first two lines as well as information from the address of the recipient of the mall piece, which follows the third line.

In a postage meter of the type shown in FIG. 1, various of the above described data portions are inputted through the keyboard of the user computer 28 to the control module 20 or are read from an envelope 34 by reader 32 connected to user computer 28. Where encryption is used, encrypting module 22 then generates an encryption number or encryption message and, upon inputting the print command by the computer operator, the encrypted message 42 is printed by the user printer 30 on line 3 of the label 36.

In operation, it will be appreciated from the following description that a portion of the address printed on the envelope 34, on the label 32, or elsewhere, may be read by reader 32 and provided to control module 20 to implement the security and allocation steps of the invention, or that such information as is inputted by the operator is detected and used to implement the invention. Although the system has been described using alpha-numerics in the address field, it will be appreciated that bar codes or other coding may be used for the desired address code.

The invention thus provides a simple and inexpensive approach to implementing a new level of customer security in a postage meter. Specifically, whether by using a very inexpensive reader, by detection and analysis of data inputted via the meter keypad, or by any other similar approach, allocation of postage funds funded by a customer is monitored and controlled. The flowcharts shown in FIGS. 3 and 4 use the USA as an example to demonstrate a manner of storing either exact DPBC, or possibly ranges of ZIP codes entered by the management of a company, to prevent incorrect allocation, or misappropriation, of postage funds.

Figure 3:
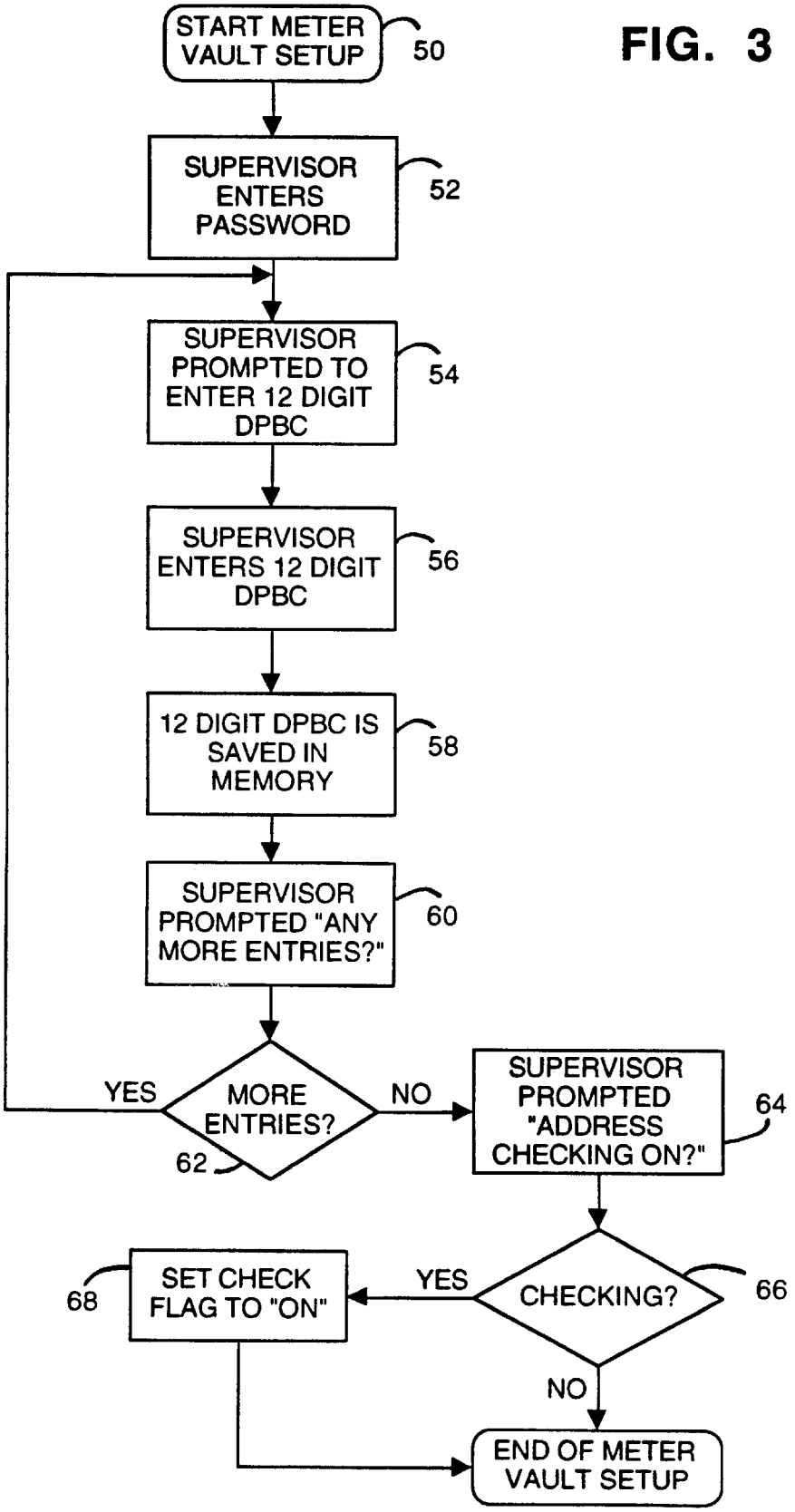
FIG. 3 is a flow chart showing a setup procedure for a vault implementing the invention.

Referring now to FIG. 3, a flow chart is shown wherein a funding customer (as represented by an employee at a level of supervisor and higher, for example) may establish a list of DPBC codes for which postage funds are (or alternatively, are not) to be released, and for instituting operation of the invention. The flow chart in FIG. 3 is used in setting up the meter vault.

As shown in FIG. 3, at step 50 an operator starts the setup procedure for the meter vault. A password is required, and at step 52 a supervisory level password is entered. In accordance with the invention, at step 54 the supervisor is prompted to enter a 12 digit DPBC (or a zip code, or a portion of a zip code). For example, a mailer who only mails out of state may define 3 digit, intra-state, zip codes for which funds are not to be allocated. At step 56 the supervisor enters the code to be added to the list and, at step 58, the control module 20 saves the added code in memory 19. At step 60, the system prompts the user to indicate whether any more entries are to be added to the list and, if any further entries remain, the user enters the same. At step 62 the system determines whether further codes have been added and, if so, returns to implement step 54 once more.

If no further codes are entered, at step 64 the system prompts the supervisor to indicate whether or not the inventive concept is to be implemented by checking future addresses (whether read by reader 32 or inputted by an operator). The supervisor's input is checked at step 66 and, if affirmative, the system sets a "check" flag at step 68 and ends the setup procedure. If the input is determined at step 66 to be negative, that is, address checking is not to be implemented at this time, the system ends the setup procedure.

Figure 4:
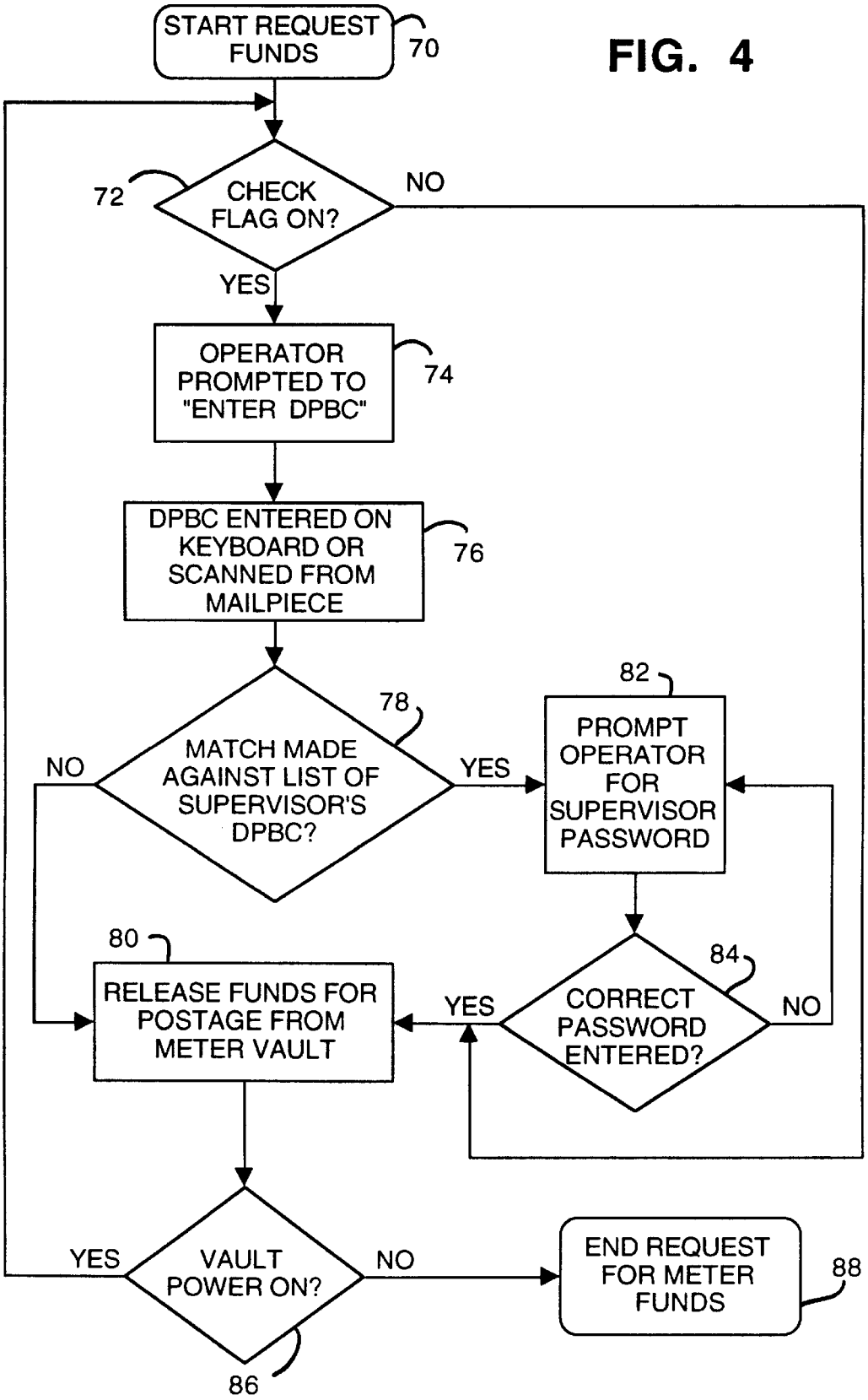
FIG. 4 is a flow chart showing operation of a vault in accordance with the invention.

Operation of a system embodying the invention is illustrated by the flow chart of FIG. 4.

At step 70, a user initiates operation of the inventive system by requesting funds disbursement—e.g., by requesting a postage value to be printed. At step 72 the system determines whether the "check" flag has been set and, if so, prompts the user at step 74 to enter the DPBC, the zip code, or other address checking code being used. If the check flag has not been set, the system disburses the requested funds by implementing step 80, which releases postage funds from the meter vault.

If the check flag has been set then, after the prompt of step 74, at step 76 the operator either enters the appropriate address code or provides a mail piece for optical (or other) reading of the appropriate address field. Having thus received the appropriate code, whether by implementation of step 76 or by variations thereof, at step 78 the system performs a matching operation between the inputted code and the list created in accordance with the flow chart of FIG. 3. If the entered address code does not match the list, the system implements step 80 and releases funds for postage from the meter vault. On the other hand, if the entered code matches an entry of the list, step 82 is implemented to request input of a password, which is then checked at step 84.

Upon verification of the password at step 84, the system implements step 80 and releases the requested postage funds. Thus, the system permits an employee at a supervisory level, for example, to access funds for mail pieces addressed to "prohibited" zones.

After releasing postage funds, at step 86 the system determines whether the vault is powered and, if so, returns to implement step 72 for another address. On the other hand, if the vault has been powered down, the system ends the process at step 88.

In the foregoing description, it should be recognized that the flow chart of FIG. 3 may be modified to provide for an additional subroutine, similar to that illustrated by steps 66 and 68, to implement proper cost allocation and accounting for the various codes saved in the list generated in steps 54–62. Specifically, an input by the supervisor may be checked to determine whether or not allocation is requested, similarly to ascertaining at step 66 whether address checking is to be implemented. Upon an affirmative result, an allocation flag may be set by a step corresponding to step 68. The flag setting procedure may be implemented alone, such as before step 54 or after step 62 of FIG. 3, causing the same list of address codes to be checked for disbursement of postage funds as well as for fund allocation and accounting. On the other hand, is will be appreciated that a separate list entry sequence may be provided in conjunction with the allocation flag setting procedure, thus to generate a list of address codes for allocation accounting which is distinct from the list of address codes used to ascertain whether or not to disburse postage funds.

In the flow chart of FIG. 4, a step may be added to correspond to step 72. In the added step it would be ascertained whether or not the allocation flag is set. If so, a sequence of steps may be implemented in which the postage value dispensed in connection with each address code on the list is identified, and totaled. The results may be printed, or further processing may be implemented to associate each such address code with a particular individual or organization to be billed.

Thus, the invention may be used to release or prevent release of postage funds for specific address codes, and to allocate and account, or not, for postage disbursed for specified address codes.

The foregoing description of the invention has been provided with reference to an accounting unit 14 that communicates with a control center 12 through a telephone 16 and with a user computer 28. However, an alternative embodiment of the invention includes the use of a portable or removable data device as a vault, in place of the accounting unit 14, as described in the '747 patent for example.

Although a detailed description of such a system is not provided, the following summarizes the manner of operation of the alternative embodiment, and its applicability to the present invention. In a system utilizing a removable data device data may be inputted into the user computer 28 without contacting the control center 12 or accounting unit 14. Specifically, the user computer 28 includes an input port adapted for receiving, and for providing communication with, a removable data device which may be a "smart credit card", or a larger enclosed structure such as a cartridge or vault, hereinafter referred to collectively as a "card". The card provides physical support for and protection of an internal microcomputer, which is connected by a private bus to a plurality of internal components. The private bus is not accessible by any user or by equipment external to the card.

The private bus connects the internal microcomputer to a read only memory (ROM) containing the operating program for the microcomputer. The program resident in the ROM both controls operation of the microcomputer and provides operating instructions by which the microcomputer communicates with the user computer.

The internal microcomputer is also connected via the private bus to a random access memory (RAM) or other operating memory, to provide dynamic data storage during operation. A nonvolatile memory (NVM), which is also on the private bus, provides nonvolatile storage for encryption data. The NVM may include the descending register value, the ascending register value, the piece count value and the like, as well as address information and any accounting or other data desired to be retained during power failure. The NVM may contain a user identification number, as well as various configuration data so that the user computer is operable in various countries which have different requirements and in various systems which have different configurations.

The private bus also connects the internal microcomputer to an encryption module that performs the same functions as described in connection with the encryption module 22.

In contrast to the private bus, a public bus is provided for communication between the user computer 28 and the card. Other devices peripheral to the user computer 28, such as additional printers, displays, communications devices and the like, can also be connected to the public bus. The public bus is a general purpose bus to allow communications between the user computer 28 and the components within the card, and between the card and the control center when the card is inserted within the input port.

In operation according to the alternate embodiment, upon insertion of the card within the input port provided therefor, the card effectively replaces the accounting unit 14 of FIG. 1 and performs the same functions as performed by the accounting unit. Postage value may be supplied to the NVM of the card through communication with the control center 12 through the public bus. Under command of the internal microprocessor information may be provided by the user computer 28 through the CRT and keyboard thereof. Thus, with the card inserted into the port all functions of the accounting unit 14 would be carried out by the card.

In that regard, it should be recognized that the user computer 28 is powered by an external source of power, not shown. In the above described alternative embodiment of the invention, during normal operation the user computer provides the power to energize the internal microcomputer, as well as the other components of the card. Power sensing circuitry, not shown. such as is disclosed in U.S. Pat. No. 4,285,050 for ELECTRONIC POSTAGE METER OPER- ATING VOLTAGE VARIATION SENSING SYSTEM, can sense the presence of falling power and cause the card's internal microcomputer to invoke a power down subroutine to complete operations in progress and store accounting data into the NVM. This power sensing circuitry may be used in implementation of step 86 of FIG. 4.

The foregoing description of the preferred embodiment of the invention has been presented for purposes of illustration and description. It is not intended to be exhaustive or to limit the invention to the precise forms disclosed, since many modifications or variations thereof are possible in light of the above teaching. For example, as hereinabove noted, the accounting module 14 may be replaced by a smart card.

Another example of a modification to the above description of the invention pertains to allocation of postage value in accordance with address codes, such as zip codes or delivery point bar codes.

All such modifications and variations are within the scope of the invention. The embodiments described herein were chosen and described in order best to explain the principles of the invention and its practical application, thereby to enable others skilled in the art to utilize the invention in various embodiments and with various modifications as are suited to the particular use contemplated therefor. It is intended that the scope of the invention be defined by the claims appended hereto, when interpreted in accordance with the full breadth to which they are legally and equitably entitled.

What is claimed is:

1. In a system for disbursing postage funds to a mail piece, including a printing means for printing a value unit on a mail piece and an accounting means for keeping an account of printed value units, the improvement wherein recipient address information is used for disbursement of said value unit to a mail piece, comprising:

(a) means for inputting to said accounting means a particular address information of a particular intended recipient of a mail piece;

(b) means within said accounting means for comparing the particular address information with a predetermined address information; and (c) means subsequently responsive to results of the comparison for allocating said value unit to said mail piece in accordance with said particular address information.

2. The system of claim 1 wherein said allocating means comprises means for preventing said printing means from printing said value unit when said particular address information matches said predetermined address information.

3. The system of claim 1 wherein said allocating means comprises means for enabling said printing means to print said value unit only when said particular address information matches said predetermined address information.

4. The system of claim 1 wherein said allocating means comprises means for summarizing value units disbursed to mail pieces addressed to each of a plurality of recipients in accordance with specified address information contained in addresses of the recipients.

5. The system of claim 1 wherein said means for inputting comprises reader means for reading address data associated with a mail piece, for selecting said particular address information from said address data and for providing the selected particular address information to said accounting module.

6. The system of claim 1 wherein said means for inputting comprises user operated address means for inputting said recipient address information to be printed on the mail piece, for selecting said particular address information from said recipient address information provided by the user and for providing the selected particular address information to said accounting module.

7. In a system for disbursing postage funds to a mail piece, including a printing means for printing a value unit on a mail piece and an accounting means for keeping an account of printed value units, the improvement wherein recipient address information is used for enabling and preventing disbursement of said value unit to a mail piece, comprising:

(a) means for inputting to said accounting means a particular address information of a particular intended recipient of a mail piece;

(b) means within said accounting means for comparing the particular address information with a predetermined address information; and (c) means subsequently responsive to results of the comparison for preventing disbursement of said value unit to said mail piece in accordance with said particular address information.

8. The system of claim 7 wherein said preventing means comprises means for preventing said printing means from printing said value unit when said particular address information matches said predetermined address information.

9. The system of claim 7 wherein said preventing means comprises means for enabling said printing means to print said value unit only when said particular address information matches said predetermined address information.

10. In a method for disbursing postage funds to a mail piece, including a step of printing a value unit on a mail piece and a step of accounting for printed value units, the improvement comprising using recipient address information for enabling and preventing disbursement of said value unit to a mail piece, comprising the steps of:

(a) inputting a particular address information of a particular intended recipient of a mail piece;

(b) comparing the particular address information with a predetermined address information; and (c) preventing disbursement of said value unit to said mail piece in accordance with a result of said comparing step and subsequent to said comparing step.

11. The method of claim 10, wherein said inputting step comprises inputting a zip code of the recipient address and said comparing step comprises comparing the inputted zip code with a stored zip code to determine whether to authorize or to prevent disbursement of said value unit to said mail piece.

12. The method of claim 10, wherein said inputting step comprises inputting a delivery point bar code of the recipient address and said comparing step comprises comparing the inputted delivery point bar code with a stored delivery point bar code to determine whether to authorize or to prevent disbursement of said value unit to said mail piece.

13. The method of claim 10, wherein said preventing step comprises preventing printing of said value unit when the result of said comparing step indicates a match between said particular address information and said predetermined address information.

14. The method of claim 10 wherein said preventing step comprises enabling printing of said value unit only when the result of said comparing step indicates a match between said particular address information and said predetermined address information.

15. The method of claim 10 comprising the further steps of:

(a) prompting a supervisor to enter an address code;

(b) storing the entered address code; and (c) setting a check flag to identify an address comparison mode of operation.

16. The method of claim 15, comprising the further steps of:

(a) prompting a user to enter an address code; and (b) determining whether said check flag is set; and wherein, when said check flag is set, said comparing step comprises comparing the address code entered by the user with the stored address code entered by the supervisor.

* * * * *